US006598389B2

(12) United States Patent
Chen et al.

(10) Patent No.: US 6,598,389 B2
(45) Date of Patent: Jul. 29, 2003

(54) INSULATED HEAT SHIELD

(75) Inventors: Colin Ching-Ho Chen, Barrington, IL (US); Frank Walter Popielas, Naperville, IL (US); Mark Boogemans, Belmont (CA); Calin Matias, London (CA)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/879,879

(22) Filed: Jun. 12, 2001

(65) Prior Publication Data

US 2002/0184880 A1 Dec. 12, 2002

(51) Int. Cl.[7] ..... F01N 7/10

(52) U.S. Cl. ..... 60/323; 60/272; 60/282; 123/169 PH; 138/149

(58) Field of Search ..... 60/272, 282, 322, 60/323, 320; 123/198 E, 195 C, 169 PH; 138/149; 137/375

(56) References Cited

U.S. PATENT DOCUMENTS

| | | | | |
|---|---|---|---|---|
| 3,845,621 A | | 11/1974 | Goto et al. | |
| 4,612,767 A | | 9/1986 | Engquist et al. | |
| 4,914,912 A | | 4/1990 | Akatsuka | |
| 4,924,669 A | | 5/1990 | Tsutsumi | |
| 5,278,002 A | * | 1/1994 | Hiers | 429/175 |
| 5,347,810 A | | 9/1994 | Moore, III | |
| 5,419,127 A | * | 5/1995 | Moore, III | 60/323 |
| 5,590,524 A | | 1/1997 | Moore, III et al. | |
| 5,816,043 A | | 10/1998 | Wolf et al. | |
| 6,026,846 A | * | 2/2000 | Wolf et al. | 137/375 |
| 6,141,958 A | * | 11/2000 | Voss | 60/272 |
| 6,318,734 B1 | * | 11/2001 | Boskamp | 277/598 |

FOREIGN PATENT DOCUMENTS

| | | | | |
|---|---|---|---|---|
| DE | 19849366 | * | 4/2000 | 60/322 |

* cited by examiner

*Primary Examiner*—Thomas Denion
*Assistant Examiner*—Binh Tran
(74) *Attorney, Agent, or Firm*—Rader, Fishman & Grauer, PLLC

(57) ABSTRACT

A heat shield provides thermal insulation and reduced noise transmission for under-the-hood vehicular engine components, such as exhaust manifolds. The structure is formed in three layers: an outer metal layer to provide structural integrity, a center insulation layer to isolate heat and dampen noise, and an inner metal layer directly adjacent the shielded component for reflecting heat back to the shielded component. As disclosed, the insulation layer is sandwiched between the two metal layers. The heat shield is formed in two integral mating halves to define a unitary structure containing grommets. The grommets incorporate capscrews rotatably secured in respective halves of the structure for attachment to mounting bosses on the component. Finally, the edges of the two metal layers of the heat shield are folded over to prevent injury to installers, and to reinforce the heat shield structure for enhancing its useful life under severe conditions of vibration and heat.

12 Claims, 3 Drawing Sheets

INSULATED HEAT SHIELD

BACKGROUND OF THE INVENTION

1. Field of Invention

The present invention relates to improved protective structures for vehicular engine parts that generate substantial heat and vibration during engine operation, such as exhaust manifolds. More particularly, the invention relates to protective heat shields applied to such parts for insulating the parts with respect to other components within an engine compartment of a vehicle.

2. Description of the Prior Art

In today's modern vehicles, the exhaust manifolds of internal combustion engines can reach under-the-hood temperatures in the neighborhood of 1600 degrees Fahrenheit. Such high temperatures can create significant risks of damage to electronic components nested under the hood. Thus protection is warranted, and has been provided via use of heat shields designed to cover up, and hence to insulate, exhaust manifolds and other heat generating components. In some cases, the shields have been effective to reduce measured temperature levels to within a range of 300 degrees Fahrenheit, along with substantial commensurate reductions in noise levels. Typical heat shields, however, comprise several metal layers that have sharp edges prone to creating cuts in the hands and/or fingers of installers of such structures.

In addition, many conventional heat shields are comprised of at least two entirely separate half-portions with at least three sets of detached capscrews and nuts required to hold the assembled half-portions together. In the typical production line, a minimum of two or three people are employed for such assembly of the heat shields, particularly when larger under the hood components, such as exhaust manifolds, are involved. Moreover, working with separate capscrew and nut components occasionally exacerbates nuisance factors in an assembly line environment, particularly in cases where several people are working together in close quarters.

SUMMARY OF THE INVENTION

The present invention provides an improved insulated heat shield for engine components, such as exhaust manifolds of engines. In the described embodiment, a heat shield is formed of two contiguous halves to form a unitary structure adapted to be secured together via bolted connections to and about an engine manifold.

In the described embodiment, the shield includes three layers; an outer layer of metal to provide overall structural integrity, a center layer of an insulation material to isolate heat and to dampen noise, and an inner layer adjacent the shielded component for reflecting heat back to the shielded component.

In the described embodiment, the edges of the metal layers are folded over to avoid cutting hands and/or fingers of installers or assemblers, or even under-the-hood wiring and hose structures. In addition, the folded over edges provide reinforcement of the heat shield structure to minimize vibration, and to thus maximize service life. In addition, the capscrews and nuts are rotatably mounted firmly on integral grommets provided in the heat shield structure to permit a single installer to assemble the heat shield without requirement of assistance from fellow workers.

DETAILED DESCRIPTION OF THE PREFERRED EMBODIMENTS

Figure 1:
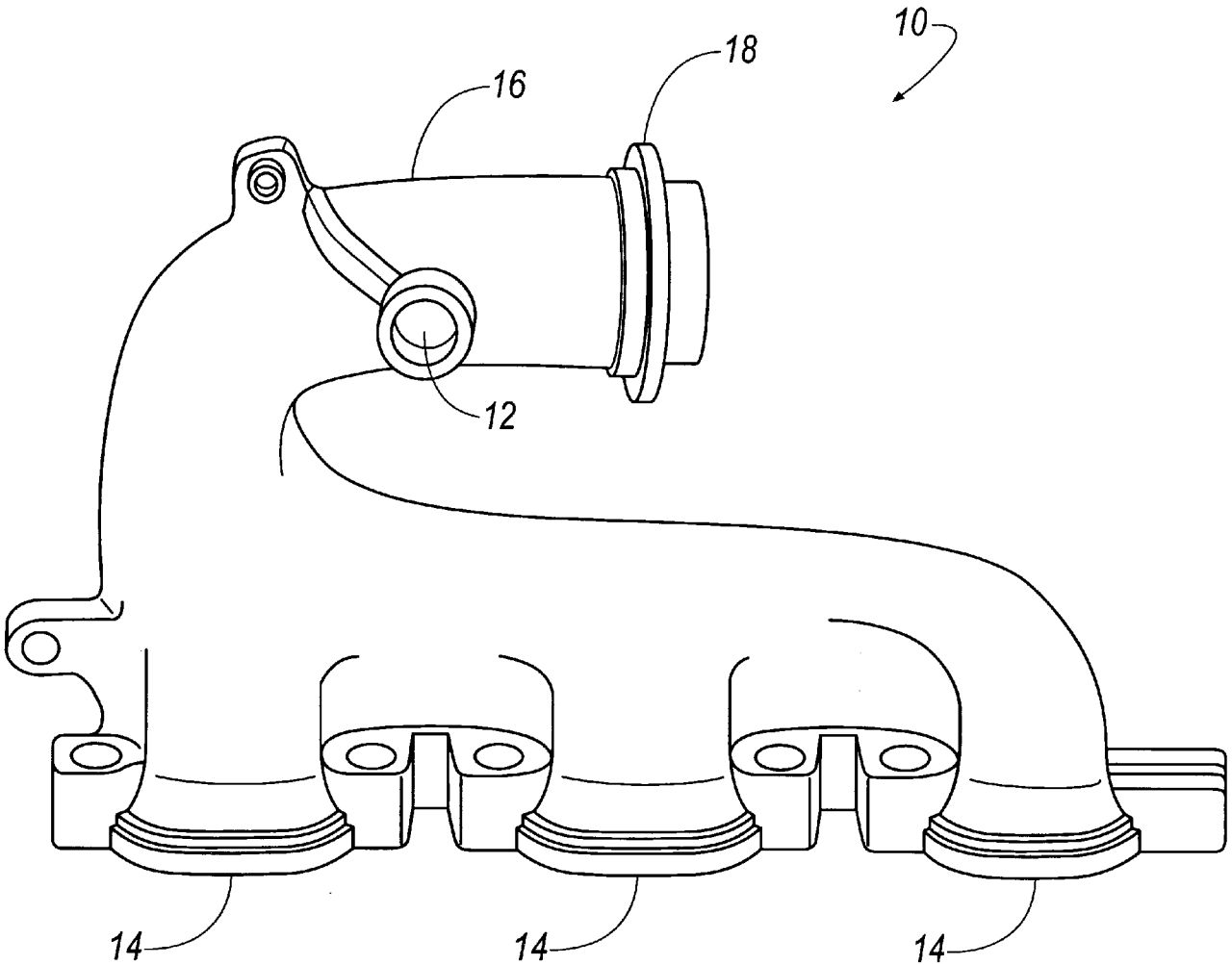
FIG. 1 (PRIOR ART)
FIG. 1 is a view of an exhaust manifold, representing a component suitable for being covered by the integral heat shield apparatus of the present invention.

Referring initially to FIG. 1, a conventional under-the-hood prior art engine component 10 is shown. The depicted component 10 is a heavy-duty cast-iron exhaust manifold adapted for being bolted to a plurality of exhaust ports of an internal combustion engine (not shown). The manifold 10 includes mounting bosses 12 for securement of a conventional metal heat shield, as will be appreciated by those skilled in the art. In the typical arrangement, a plurality of such bosses 12 are provided.

The engine manifold 10 also contains a plurality of exhaust port flanges 14 for mounting the manifold 10 to the plurality of cylinder head exhaust ports of the aforesaid internal combustion engine. Those skilled in the art will appreciate that the exhaust port flanges 14 operate to collectively receive exhaust gases from individual combustion chambers of each engine, and to funnel the exhaust gases into a common port for transmission thereof out of the vehicle by way of an exhaust pipe portion 16 of the manifold 10. A mounting flange 18 is integrally provided on the exhaust pipe portion 16, as will also be appreciated by those skilled in the art.

Figure 2:
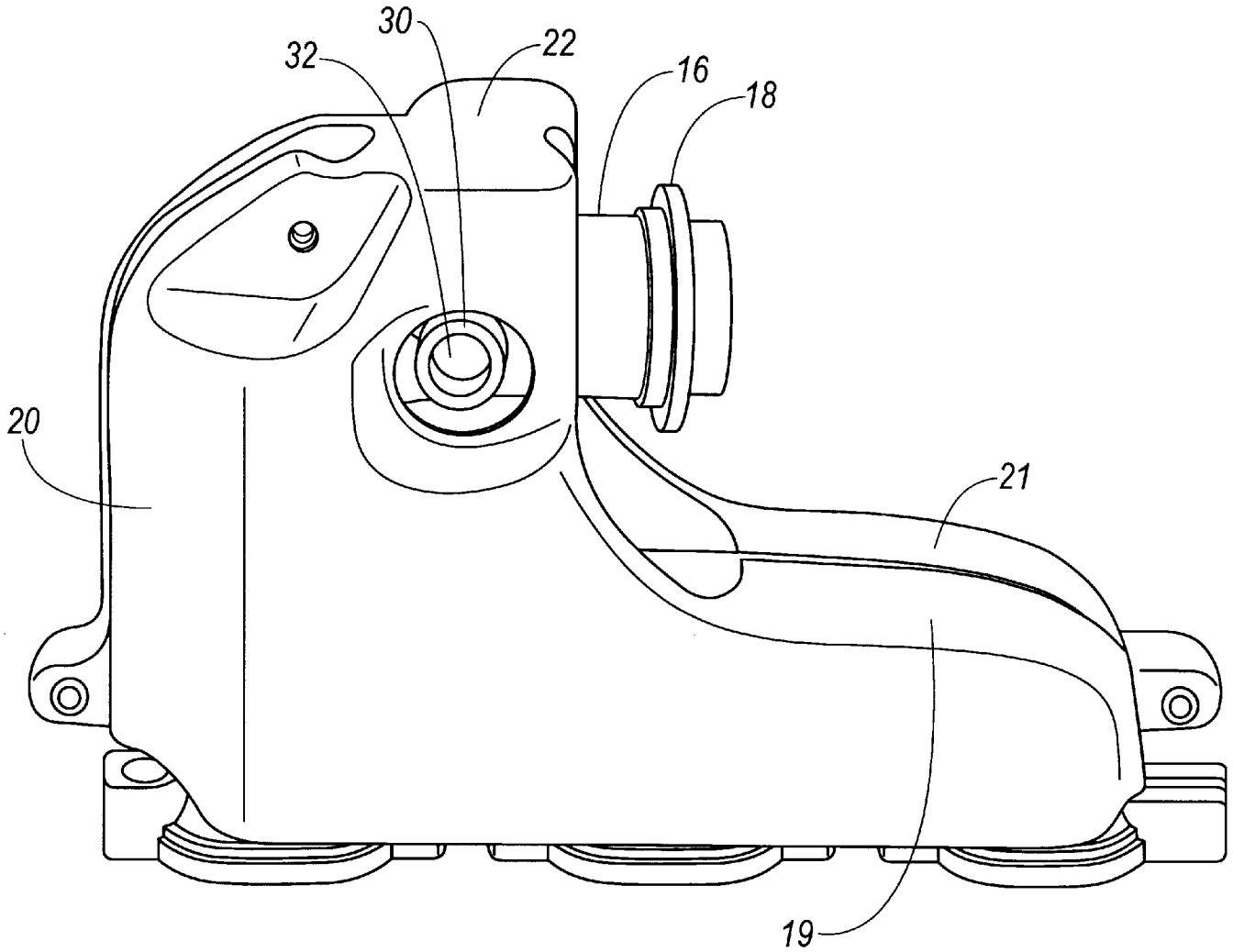
FIG. 2 is a view of one described embodiment of the heat shield of the present invention, installed over the exhaust manifold component of FIG. 1.
Figure 3:
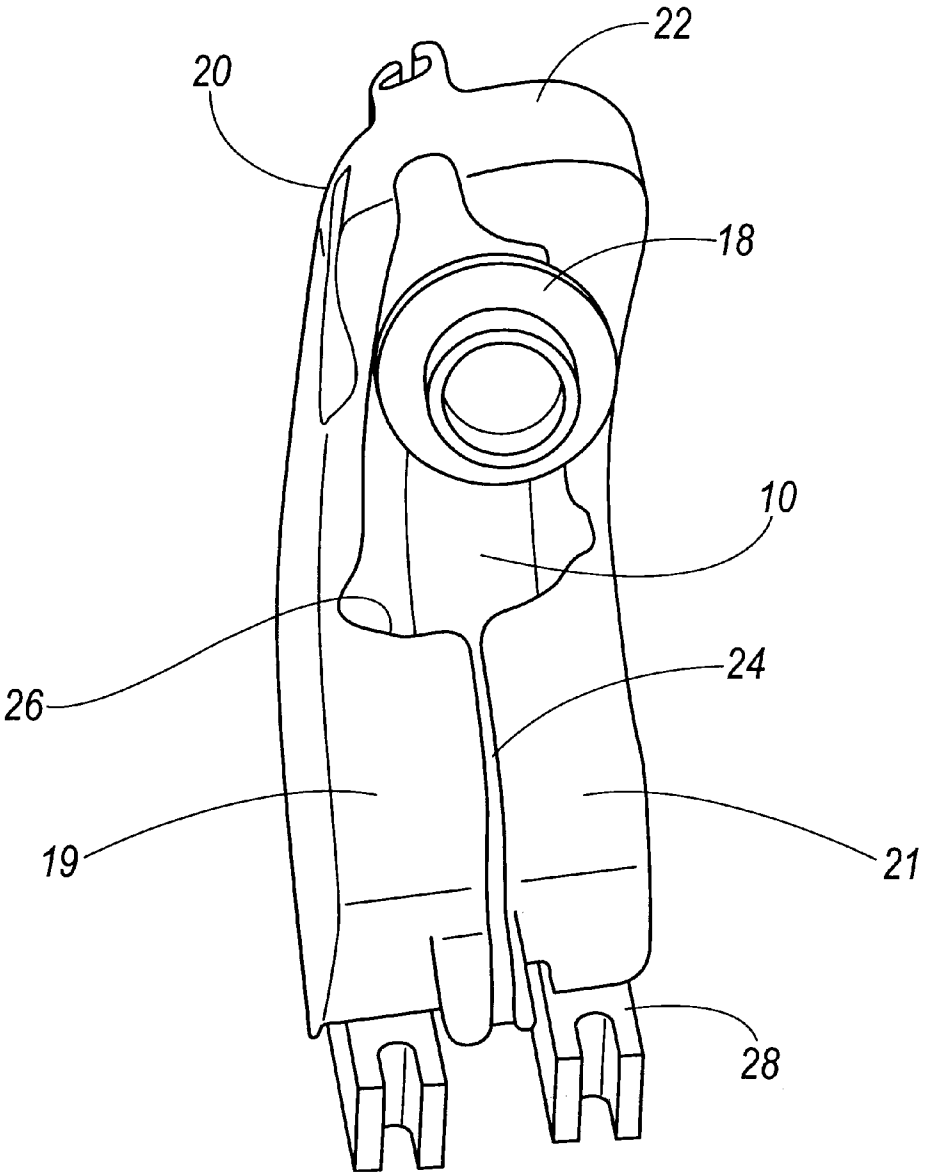
FIG. 3 is a view of the embodiment of the heat shield of FIG. 2, rotated to reveal an aperture for accommodating protruding portions of the exhaust manifold component.

Referring now to FIGS. 2 and 3, an integral, one-piece heat shield 20 is adapted to substantially encase the manifold 10, as depicted. The heat shield 20 is defined by a pair of half-portions 19 and 21 that are integrally coupled together by a continuous bridge portion 22. As will be apparent with particular reference to FIG. 3, a split or gap 24 between half-portions 19 and 21 provides flexibility of installation onto the manifold 10. In addition, at least one aperture 26 is provided in the heat shield 20 for accommodating protrusions of the exhaust pipe portion 16 and its associated mounting flange 18. In the described embodiment, the aperture 26 is uninterrupted except for the intersection of the aperture with the gap 24 that extends lengthwise or longitudinally between half portions 19 and 20 and shown. The gap 24 defines a medial separation between the half-portions to permit the half-portions to be resiliently spread apart within limits as may be required.

Continuing reference to FIG. 3, the heat shield 20 incorporates edges or extremities 28 that are folded over, and are thus trimmed to avoid injuries such as the cutting of hands and/or fingers of production line workers, or property damage such as cutting of the hoses and wires already attached in place to the engine.

Those skilled in the art will recognize and appreciate the flexibility accorded by the design of the heat shield 20. To the extent that the heat shield body is formed of one piece, it is more easily installed over the manifold 10 than are conventional two-piece heat shields. To further facilitate ease of assembly, the heat shield 20 contains mounting grommets 30 that contain rotatable fasteners 32, such as capscrews shown rotatably mounted within the grommets 30. A plurality of such grommets and capscrews are employed in the embodiment described; normally at least two would be provided, one in each of the half-portions 19 and 21. Depending on geometry and/or operating conditions of a particular engine, more of such grommets may be required to alleviate particularly difficult vibration issues, as those skilled in the art will appreciate.

In the described embodiment, the heat shield 20 incorporates three layers; an outer layer of metal to provide structural integrity and overall rigidity, a center layer of insulation material to isolate temperature and to dampen of vibration and noise, and an inner metal layer adjacent the shielded component for reflecting heat back to the shielded component. The outer metal layer can be preferably formed of cold rolled steel, aluminized steel, aluminum, and even stainless steel in more exotic vehicles where cost is less of a factor. If cold rolled steel is utilized, the exterior of the shield should be coated with a corrosion-resistant material to enhance the longevity of the shield.

The inner metal layer is the portion of the shield 20 that is in closest contact with the exhaust manifold. To the extent that the temperatures of the manifold can reach the 1600 degrees Fahrenheit range, the material of the inner metal layer should be able to withstand significant heat. In some applications the inner layer may be formed of high-temperature alloys, and in others can perhaps be of a cheaper aluminum-clad steel. Those skilled in the art will appreciate that choice of materials may be critical for avoiding degradation associated with elevated temperatures and considerable vibrations in particular applications.

The material choices of the insulating and dampening center layer can be fairly broad. Such choices can include non-metallic fibers such as aramid fibers, or ceramic fiber paper. Depending on anticipated temperature ranges, even nonfiber compositions can be employed, such as densified vermiculite powders, as those skilled in the art will appreciate.

One method of manufacturing of the heat shield 20 can be described as follows. The inner and outer metal layers are stamped from sheet metal, and then formed in a progressive die to the shapes depicted. The insulation layer is applied onto the outer metal layer, and then the inner metal layer is placed atop the insulation layer. Next the previously described edges 28 of the slightly oversized outer layer are folded over the respective mated edges of the inner metal layer, thus encapsulating the insulation layer between the metal layers. The grommets 30 along with the capscrews 32 can be applied via conventional methods, for example with the grommets 30 being trapped between the inner and outer metal layers, the capscrews 32 being rotatably secured within the grommets 30, as can be purchased from a manufacturer.

Those skilled in the art will appreciate that the unitary one-piece heat shield 20 can be handled by a single installer as opposed to a group of two or three installer as required to handle the conventional two-piece heat shield installation. The integrally contained mounting grommets 30, including the capscrews 32 rotatably mounted in the grommets, further facilitate fitment and securement of the heat shield 20 to the manifold component 10.

It is to be understood that the above description is intended to be illustrative and not limiting. Many embodiments will be apparent to those of skill in the art upon reading the above description. Therefore, the scope of the invention should be determined, not with reference to the above description, but instead with reference to the appended claims, along with the full scope of equivalents to which such claims are entitled.

What is claimed is:

1. A heat shield for an under-the-hood vehicular engine component comprising three layers: an outer metal layer, an insulation layer, and an inner metal layer positioned directly proximal to the shielded component, said insulation layer selectively positionable intermediately between said metal layers, said layers collectively providing thermal insulation of, and reduced noise transmission from, said component, wherein said heat shield is formed in at least a pair of integral mating portions to define a unitary structure containing mounting grommets, wherein said grommets incorporate fastening members rotatably secured in respective portions of said shield, wherein said fastening members selectively attach said shield to said component.

2. A heat shield for an under-the-hood vehicular engine component comprising:

at least three layers: an outer metal layer, an insulation layer, and an inner metal layer that is selectively positionable directly proximal to the shielded component;

said insulation layer positioned intermediately between said outer and inner metal layers;

wherein said outer and inner metal layers and said insulation layer collectively providing thermal insulation of, and reduced noise transmission from, said component;

wherein said heat shield is formed in at least a pair of integral mating longitudinally extending half portions that are connected together by an integral bridge to define a unitary structure generally corresponding in shape to said component so as to encase said component when said shield is selectively attached to said component;

said shield further containing mounting grommets, wherein said grommets incorporate fastening members rotatably secured in respective portions of said shield, wherein said fastening members selectively attach said shield to said component.

3. The heat shield of claim 2, wherein circumferential edges of the two metal layers of the heat shield are folded over to reinforce said heat shield structure under conditions of vibration and heat.

4. The heat shield of claim 2, wherein said component comprises an exhaust manifold fixed to said engine for carrying hot engine gases away from said engine.

5. The heat shield of claim 3 wherein said fastening members comprise capscrews and nuts rotatable within said mounting grommets.

6. The heat shield of claim 4 wherein said capscrews and nuts selectively engage mounting bosses for securement of said heat shield to said component.

7. The heat shield of claim 6 further comprising a gap that extends longitudinally between said half portions, and wherein said gap also defines a medial separation between said half-portions.

8. The heat shield of claim 7 wherein said inner metal layer directly adjacent said shielded component reflects heat back to the shielded component.

9. The heat shield of claim 8 further comprising at least one aperture for accommodating protruding portions of said component, wherein said aperture is interrupted by said gap that extends medially between said half portions.

10. The heat shield of claim 9 wherein said circumferential edges of said metal layers of said heat shield are folded over to protect hands and fingers of an installer from contact with sharp edges.

11. A heat shield for an under-the-hood vehicular engine component comprising three layers: an outer metal layer, an insulation layer, and an inner metal layer selectively positionable directly proximal to the shielded component, said insulation layer positioned intermediately between said metal layers, said layers collectively providing thermal insulation of, and reduced noise transmission from, said component, wherein said heat shield is formed in at least a pair of integral mating portions to define a unitary structure containing mounting grommets, wherein said grommets incorporate fastening members rotatably secured in respective portions of said shield, wherein said fastening members selectively attach said shield to said component, wherein said heat shield further comprises at least one aperture for accommodating protruding portions of said component, and wherein said aperture is interrupted by a gap that extends medially between said half portions.

12. A heat shield for an under-the-hood vehicular engine component comprising three layers: an outer metal layer, an insulation layer, and an inner metal layer selectively positionable directly proximal to the shielded component, said insulation layer positioned intermediately between said metal layers, said layers collectively providing thermal insulation of, and reduced noise transmission from, said component, wherein said heat shield is formed in at least a pair of integral mating portions to define a unitary structure containing mounting grommets, wherein said grommets incorporate fastening members rotatably secured in respective portions of said shield, wherein said fastening members selectively attach said shield to said component, wherein said heat shield comprises two longitudinally extending half portions connected by an integral bridge to define a unitary body, wherein circumferential edges of said two metal layers of the heat shield are folded over to reinforce said heat shield structure under conditions of vibration and heat, wherein said component comprises an exhaust manifold fixed to said engine, wherein said exhaust manifold carries hot engine gases away from said engine, wherein said fastening members comprise capscrews and nuts rotatable within said mounting grommets, wherein said capscrews and nuts selectively engaging mounting bosses for securement of said heat shield to said component, wherein said heat shield further comprises a gap that extends longitudinally between said half portions, wherein said gap also extends medially between said half portions, wherein said heat shield further comprises at least one aperture for accommodating protruding portions of said component, and wherein said aperture is interrupted by said medially extending gap.

* * * * *

UNITED STATES PATENT AND TRADEMARK OFFICE

CERTIFICATE OF CORRECTION

PATENT NO. : 6,598,389 B2
DATED : July 29, 2003
INVENTOR(S) : Colin C. Chen et al.

It is certified that error appears in the above-identified patent and that said Letters Patent is hereby corrected as shown below:

Title page,
Item [75], please add the following inventors:
-- Bryan S. Breen, Walled Lake, MI and
Matthew B. Chapman, Linden, MI --

Signed and Sealed this

Eighteenth Day of November, 2003

JAMES E. ROGAN
*Director of the United States Patent and Trademark Office*